United States Patent [19]

Gebhart et al.

[11] 4,067,661

[45] Jan. 10, 1978

[54] THERMALLY COMPENSATED VARIABLE TURBINE NOZZLE POSITION INDICATOR

[75] Inventors: Daniel E. Gebhart, East Peoria; Edward G. Meints; Brace C. Smith, both of Peoria, all of Ill.

[73] Assignee: Caterpillar Tractor Co., Peoria, Ill.

[21] Appl. No.: 728,590

[22] Filed: Oct. 1, 1976

[51] Int. Cl.[2] ..... F01B 25/26; F01D 17/12

[52] U.S. Cl. ..... 415/118; 415/150; 415/160

[58] Field of Search ..... 415/118, 150, 160

[56] References Cited

U.S. PATENT DOCUMENTS

| | | | |
|---|---|---|---|
| 2,265,952 | 12/1941 | Montgomery | 415/118 X |
| 2,677,273 | 5/1954 | Johnson | 415/118 X |
| 3,013,771 | 12/1961 | Henny | 415/160 |
| 3,841,790 | 10/1974 | Stein et al. | 415/147 X |
| 3,904,309 | 9/1975 | Keetley | 415/160 X |
| 4,003,675 | 1/1977 | Stevens et al. | 415/160 X |

*Primary Examiner*—William L. Freeh
*Assistant Examiner*—Leonard Smith
*Attorney, Agent, or Firm*—Phillips, Moore, Weissenberger, Lempio & Majestic

[57] ABSTRACT

The invention is concerned with an improvement in a movable vane assembly of the type used in a gas turbine engine or compressor for interaction with a gas stream. Most particularly, the invention is an improved temperature independent means for indicating the rotational position of a plurality of radially aligned vanes circumferentially arranged in an annular passage formed by a housing, said vanes being supported for rotation about their radial axes to vary the effective cross-sectional area of said annular passage, a plurality of rotatable gear means connected for rotation with said plurality of aligned vanes, a ring gear having teeth means adapted for simultaneous engagement with teeth means of said plurality of rotatable gear means such that rotation of said ring gear causes rotation of said plurality of vanes, actuating means including first and second link means connected at first and second diametrically opposed points on said ring gear, and motor means for simultaneously actuating said first and second link means to rotate said ring gear. The improved temperature independent means of the present invention comprises a potentiometer having a body and a stem rotatable with respect to the body with the resistance of the potentiometer being a function of the relative rotation between the body and the stem. Means are provided mounting the body to rotate a first distance in a first direction responsive to a first change in size of the first link means. Means are provided mounting the stem to rotate said first distance in said first direction responsive to a second change in size of said second link means which is proportional to said first change in size of said first link means. Further means are provided indicating the resistance of the potentiometer.

5 Claims, 3 Drawing Figures

10
20
22
26
24
28
27
16
18
30
14
12
31
II
II

THERMALLY COMPENSATED VARIABLE TURBINE NOZZLE POSITION INDICATOR

BACKGROUND OF THE INVENTION

1. Field of the Invention

The invention is concerned with movable vane assemblies of the type used in a gas turbine engine or a compressor for interaction with a gas stream. More particularly, the invention is concerned with an improved temperature independent means for indicating the rotational position of a plurality of radially aligned vanes which are used to vary the effective cross sectional area of an annular passage through which gas flows in a gas turbine engine or compressor.

2. Prior Art

Variable area nozzles are utilized in gas turbine engines to improve the efficiency over relatively wide ranges of motor speeds. In such nozzles, it is necessary to accurately position each of plurality of movable vanes and to maintain them in selected positions during the operation of the turbine motor. Such accuracy of positioning is difficult to maintain due to, for example, excessive tolerances arriving at a drive arrangement for positioning the vanes, to distortion caused by the flow of hot gases through the nozzles, and to distortion caused by imbalanced loading on the actuator parts.

In the prior art, one arrangement for controlling movable nozzle vanes employs a ring gear arranged about the nozzle vanes for simultaneous positioning thereof. Exemplary of such prior art systems are those disclosed in U.S. Pat. Nos. 3,252,686 to Chadwick; 3,383,090 to McLean; and 3,376,028 to Williamson. Each of these arrangements utilize single actuator jacks for rotating a ring member which causes a simultaneous actuation of a plurality of vanes through connecting means. Such systems, due to the single point force application from the actuator jack, cause an imbalance of loading on the ring member which can lead to distortion of the parts and inaccuracy in nozzle placement.

Other prior art devices utilize a plurality of separate actuator jacks connected to various points along a ring gear to position the same. Again, an imbalance of forces on the ring gear is occasioned by an unequal or imprecise movement of the multiple jacks. Copending U.S. application Ser. No. 609,764, now U.S. Pat. No. 4,003,675, commonly assigned herewith and filed Sept. 2, 1975, discloses a vane positioning system which comprises a ring gear acted upon at two diametrically-opposed peripheral points by dual bell crank linkages which in turn are acted upon by a single double-acting hydraulic motor. The motor is free to move between the two bell crank connections and they thus exert equal and opposite forces upon each of the bell crank linkages to produce a balanced force upon the ring gear. Rotation of the ring gear causes simultaneous adjustment of a plurality of movable nozzle vanes.

The present invention is directed to an improved temperature independent means for indicating the rotational position of such nozzle vanes as are motivated by such dual bell crank linkages as are disclosed in U.S. patent application Ser. No. 609,764 and other related linkages.

SUMMARY OF THE INVENTION

The present invention is concerned with a movable vane assembly of the type used in a gas turbine engine or compressor for interaction with a gas stream comprising a plurality of radially aligned vanes circumferentially arranged within an annular passage formed by a housing, said vanes being supported for rotation about their radial axes to vary the effective cross sectional area of said annular passage, a plurality of rotatable gear means connected for rotation with said plurality of aligned vanes, a ring gear having teeth means adapted for simultaneous engagement with teeth means of said plurality of rotatable gear means such that rotation of said ring gear causes rotation of said plurality of vanes, actuating means including first and second link means connected at first and second diametrically opposed points on said ring gear and motor means for simultaneously actuating the first and second link means to rotate the ring gear. More particularly, the invention is concerned with an improved temperature independent means in such a system for indicating the rotational position of the vanes. The improved temperature independent means comprises a potentiometer having a body and a stem rotatable with respect to the body with the resistance of the potentiometer being a function of the relative rotation between the body and the stem. Means are provided for mounting the body to rotate a first distance in a first direction responsive to a first change in size of the first link means. Means are provided mounting the stem to rotate said first distance in said first direction responsive to a second change in size of said second link means which is proportional (generally equal) to said first change in size of said first link means. Means are further provided indicating the resistance of the potentiometer.

BRIEF DESCRIPTION OF THE DRAWINGS

The invention will be better understood by reference to the figures of the drawings wherein like numbers denote like parts throughout and wherein.

DETAILED DESCRIPTION OF THE PREFERRED EMBODIMENT

Figure 1:
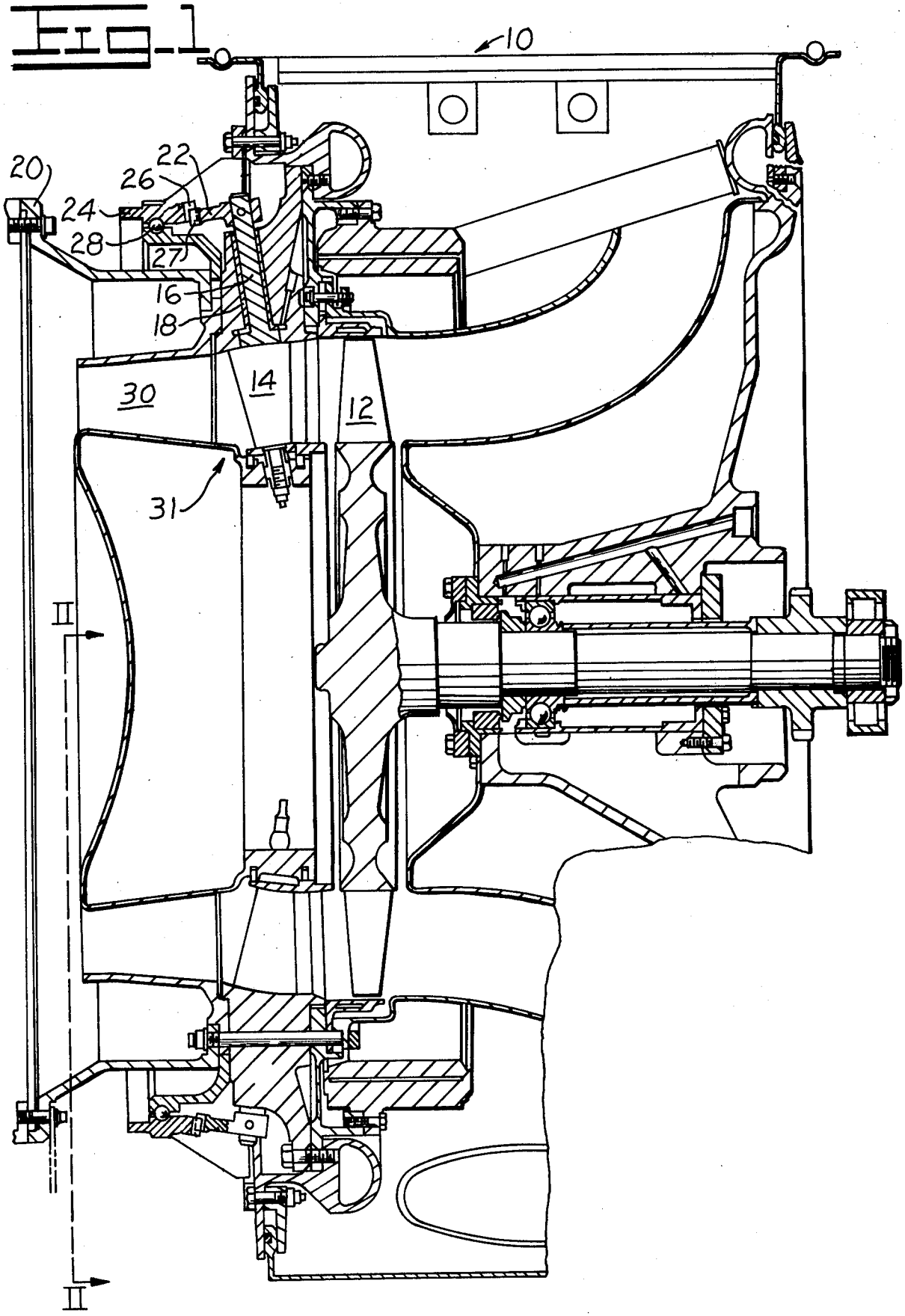
FIG. 1 is a sectional elevation of a portion of a gas turbine engine equipped with a rotational position indicating the means of the present invention.

Turning first to FIG. 1, illustrated therein is a portion of a gas turbine engine 10 which includes a conventional rotor 12 and a plurality of variable area nozzle vanes 14. The nozzle vanes 14 are each rotatably mounted upon a plurality of shafts 16 which are journaled within a suitable plurality of bearings 18 within a turbine housing 20. Each of the shafts 16 is equipped with a gear segment 22 which is keyed thereto so that when the gear segment is angularly displaced, the shaft 16 and vane 14 moves proportionally. The engine 10 also includes a ring gear 24, having a plurality of teeth 26 adapted to engage the teeth 27 on the respective gear segments 22. The ring gear 24 is suitably mounted for rotation on a plurality of bearings 28 (or any suitable sleeve bearing) on another portion of the housing 20. Rotation of the ring gear 24 causes simultaneous actuation of each of the gear segments 22 and consequent simultaneous activation of each of the nozzle vanes 14. Each of the nozzle vanes 14 is arranged within an annular passage 30 formed by the housing 20 to form an overall movable vane assembly 31.

Figure 2:
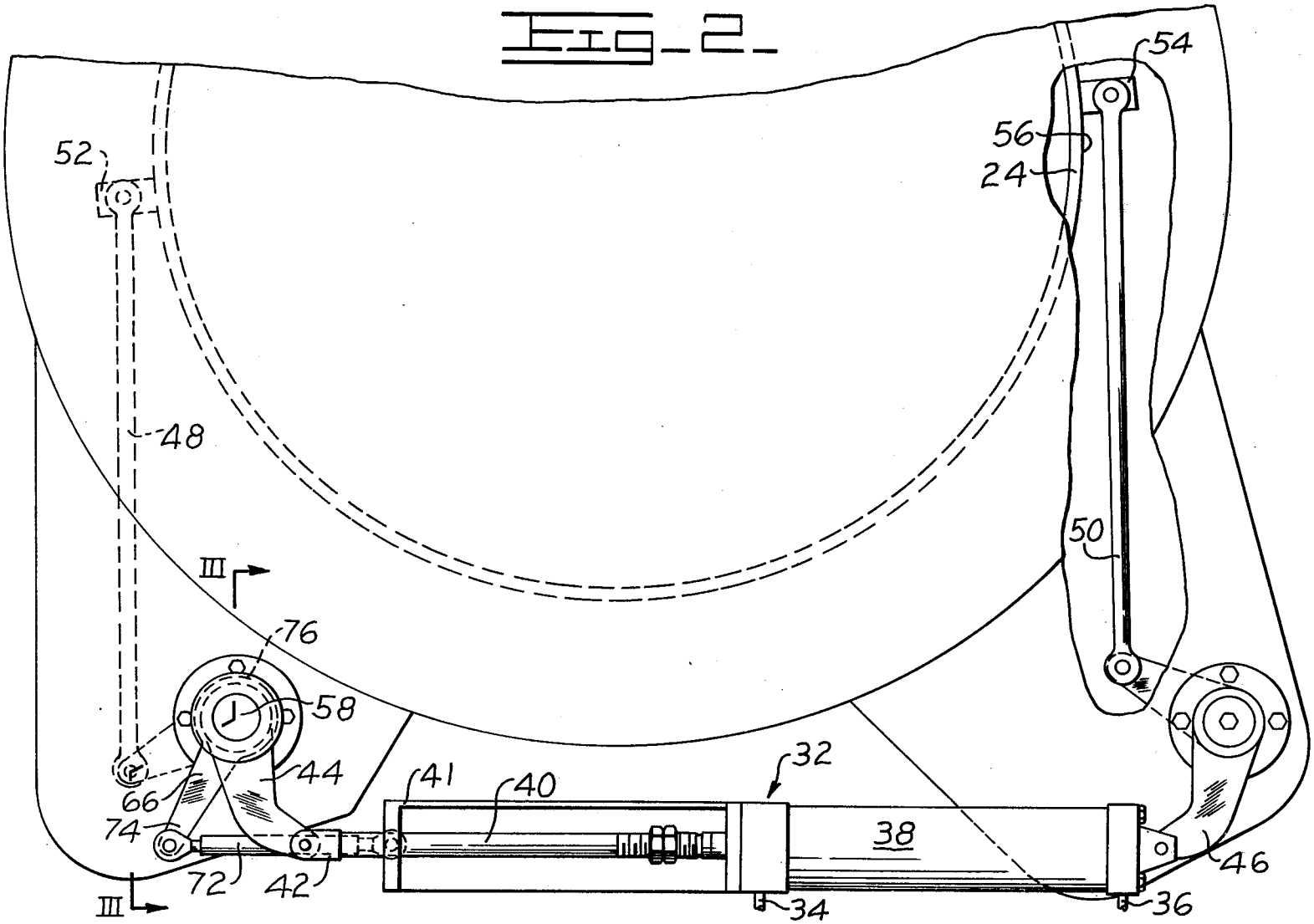
FIG. 2 is a partial sectional view taken along the line II—II of FIG. 1.
Figure 3:
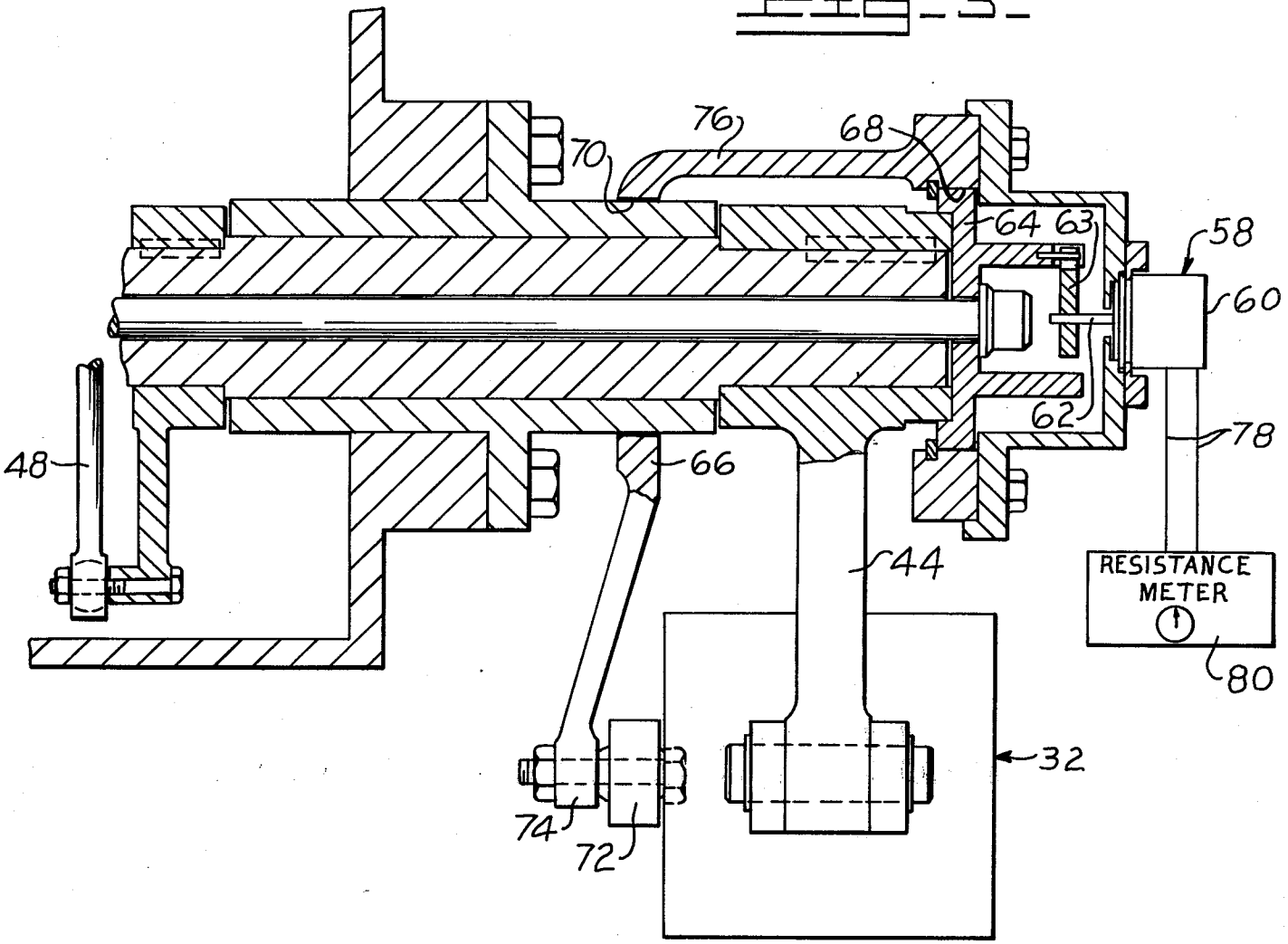
FIG. 3 is a partial section, considerably blown up, taken along the line III—III of FIG. 2.

Referring primarily to FIGS. 2 and 3, the ring gear 24 is actuated through use of a single double-acting fluid motor such as a hydraulic cylinder 32. The hydraulic cylinder 32 is of conventional construction and is equipped with conduits 34, 36 for supplying and exhausting fluid under pressure to and from opposite ends of a chamber within a cylinder body 38. The hydraulic cylinder has a rod 40, a frame 41 extending from the body 38 and a connector 42 which, when extended or retracted causes rotation of a pair of bell cranks 44, 46, respectively. The bell cranks 44, 46 are in turn connected to a pair of link means namely the pair of links 48, 50, respecively, which are pivotally connected to a pair of bosses 52, 54, respectively, disposed in diametrical opposition upon a periphery 56 of the ring gear 24. Upon actuation of the free-floating hydraulic cylinder 32, equal and opposite forces are exerted through the rod 40 and connector 42 upon the bell cranks 44, 46, respectively, to exert balanced forces on the bosses 52, 54, respectively, to cause the ring gear 24 to rotate the consequent adjustments of the nozzle vanes 14.

Referring now particularly to FIGS. 2 and 3, the inventive concept of the present invention will be most readily appreciated. The potentiometer 58, having a body portion 60 and a stem 62 leaving the body generally centrally therefrom and rotatable within the body 60, form an important part of the present invention. The body 60 of thc potentiometer 58 is mounted co-axially with the axis of rotation of the bell crank 44. The stem 62 of the potentiometer 58 is also aligned co-axially with the axis of rotation of the bell crank 44. The stem 62 of the potentiometer 58 is linked to rotate directly with the bell crank 44 via a bar 63 and appropriate mounting means 64. The body 60 of the potentiometer 58 is mounted co-axially with the axis of the bell crank 44, as previously mentioned, and is further mounted to a lever 66 via bearing means 68, 70 so that as the lever 66 is rotated about its common rotational axis with the bell crank 46, the potentiometer body 60 is likewise rotated about the axis of the bell crank 44. In the embodiment illustrated, rotation of the lever 66 is actuated by an adjustable linear member 72 which extends from the stop 41 of the hydraulic cylinder 32. The linear member 72 pivotally connects with a first end 74 of the lever 66 while a second end 76 of the lever 66 rotatably fits about the bell crank 44 at the bearing means 68, 70. The linear member 72 is generally made adjustable as by making the ends thereof threadable into the body thereof so as to provide correction for manufacturing variations in parts sizes. Conventional electric leads 78, as illustrated schematically in FIG. 3, lead off to a resistance-measuring device such as a resistance meter or bridge 80. In this manner, the resistance of the potentiometer can be constantly measured. In a usual manner, the resistance of the potentiometer is a function of the relative rotation of the stem 62 thereof and the body 60 thereof. Because of the particular mechanical mounting of the potentiometer body 60 and the potentiometer stem 62, the relative rotation of the body 60 and the stem 62 is then determined by the relative positions of the lever 66 (the bell crank 46) and the bell crank 44. It is clear then that the reading of the resistance meter 80 will be determined by the relative rotation of the body 60 and stem 62 of the potentiometer 58 as determined by the rotational position of the lever 66 (the bell crank 46) and of the bell crank 44. In a manner which will be explained in more detail with respect to the operation of the apparatus of the present invention, the relative positions of the bell crank 44 and the lever 66 will indicate the rotational position of the vanes 14 whereby the reading of the resistance meter 30 will overall indicate the position of the vanes 14.

OPERATION

In operation, the vanes 14 are set to desired rotational position by use of the actuating hydraulic cylinder 32. At this time, the resistance meter 80 will measure the resistance of the potentiometer 58 and will indicate a particular value. As the engine 10 heats up during operation, the links 48, 50 will likewise heat up. In the particular embodiment illustrated most clearly in FIG. 2, the links 48, 50 will be within the housing 20 of the engine 10 and will thus be especially sensitive to temperature changes therewithin and will change greatly in dimension or, more particularly, in length as the engine alternately heats and cools them. Because of the generally symmetrical placement of the links 48, 50 within the housing 20 of the engine 10, each of these links 48, 50 will expand or contract linearly generally an equal amount on heating and cooling thereof. As the link 50 expands, the second bell crank 46 will be forced to rotate in a counterclockwise direction thus pulling upon the hydraulic cylinder 32 to move it rightwardly which will in turn cause the lever 66 to be moved rightwardly at its first end 74 whereby the body 60 of the potentiometer 58 will be rotated in a counterclockwise direction a first distance. As the first link 48 expands a generally equal amount to the rotation of the second link 50, the first bell crank 44 will be forced to rotate in a counterclockwise direction a generally equal amount to the rotation of the second bell crank 46 whereby the stem 62 of the potentiometer 58 will be rotated an equal amount with the body 60 thereof. It will be noted that the counterclockwise movement of the second bell crank 46 will not cause any movement of the first bell crank 44 by acting through the hydraulic cylinder 32 since the first bell crank 44 will already be moving an equal direction rotationally to the second bell crank 46 under the action of the first expanding link 48.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. In a movable vane assembly of the type used in a gas turbine engine or compressor for interaction with a gas stream comprising a plurality of radially aligned vanes circumferentially arranged within an annular passage formed by a housing, said vanes being supported for rotation about their radial axes to vary the effective cross-sectional area of said annular passage, a plurality of rotatable gear means connected for rotation with said plurality of aligned vanes, a ring gear having teeth means adapted for simultaneous engagement with teeth means of said plurality of rotatable gear means such that rotation of said ring gear causes rotation of said plurality of vanes, actuating means including first and second link means connected at first and second diametrically-opposed points on said ring gear and motor means for simultaneously actuating said first and second link means to rotate said ring gear, an improved temperature independent means for indicating the rotational position of said means, comprising:

a potentiometer having a body and a stem rotatable with respect to said body with the resistance of said potentiometer being a function of the relative rotation between said body and said stem:

means mounting said body to rotate a first distance in a first direction responsive to a first change in size of said first link means:

means mounting said stem to rotate said first distance in said first direction responsive to a second change in size of said second link means which is proportional to said first change in size of said first link means; and means indicating the resistance of said potentiometer and thereby the rotation of said vanes.

2. An improved vane position indicating means as in claim 1 wherein said first and second link means extend within said housing.

3. An improved vane position indicating means as in claim 1 wherein said second change in size is equal to said first change in size.

4. An improved vane position indicating means as in claim 1 wherein said actuating means includes first and second actuating bell crank means connected between said first and second link means, respectively, and said motor means is connected to rotate each of said first and second actuating bell crank means at equal angles on operation thereof.

5. An improved vane position indicating means as in claim 4 wherein said potentiometer body is mounted on a first lever at a pivot axis thereof, and including means for rotating said first lever proportionately responsive to rotation of said second actuating bell crank means, and wherein said potentiometer stem is mounted to said first actuating bell crank means at a pivot axis thereof, said first lever and said first actuating bell crank are co-axial, and including means for rotating said potentiometer stem responsive to rotation of said first actuating bell crank means.

* * * * *